US009457402B2

(12) United States Patent
Barge et al.

(10) Patent No.: US 9,457,402 B2
(45) Date of Patent: Oct. 4, 2016

(54) LEAD DELIVERY APPARATUS

(71) Applicant: TBS ENGINEERING LIMITED, Cheltenham (GB)

(72) Inventors: Christopher S. Barge, Bristol (GB); Mark Ormerod, Cheltenham (GB)

(73) Assignee: TBS ENGINEERING LIMITED, Cheltenham (GB)

( * ) Notice: Subject to any disclaimer, the term of this patent is extended or adjusted under 35 U.S.C. 154(b) by 0 days.

(21) Appl. No.: 14/067,242

(22) Filed: Oct. 30, 2013

(65) Prior Publication Data

US 2014/0116637 A1 May 1, 2014

Related U.S. Application Data

(60) Provisional application No. 61/720,365, filed on Oct. 30, 2012.

(51) Int. Cl.
*B22D 39/02* (2006.01)
*B22C 9/08* (2006.01)

(52) U.S. Cl.
CPC ..... *B22D 39/02* (2013.01)

(58) Field of Classification Search
CPC ..... B22C 9/08; B22D 39/02
USPC ..... 164/271, 337, 133
See application file for complete search history.

(56) References Cited

U.S. PATENT DOCUMENTS

| | | | | |
|---|---|---|---|---|
| 1,323,583 | A * | 12/1919 | Earnshaw | 164/124 |
| 4,580,616 | A * | 4/1986 | Watts | 164/457 |
| 5,858,415 | A | 1/1999 | Bequette et al. | |
| 6,123,142 | A | 9/2000 | Ratte | |
| 6,896,031 | B2 * | 5/2005 | Ratte | 164/133 |

FOREIGN PATENT DOCUMENTS

JP 2004239806 A 8/2004

OTHER PUBLICATIONS

British Search Report for Great Britain Application No. GB1219469.2, dated Feb. 28, 2013.

* cited by examiner

*Primary Examiner* — Kevin P Kerns
(74) *Attorney, Agent, or Firm* — Marshall, Gerstein & Borun LLP

(57) ABSTRACT

An apparatus for delivering a predetermined volume of lead to a mould includes a housing defining a lead reservoir having a lead outlet defined in its base and in communication with the reservoir. A runway is provided beneath the base, spaced from the base and generally parallel thereto. A block is provided slidably mounted between the base and the runway and defining a through cavity having the predetermined volume for receiving lead from the outlet in a first position and for releasing the lead in a second position. A mechanism is provided for reciprocating the block between the first and second positions. A cast on strap machine is also disclosed. A lead delivery apparatus comprising a delivery chute is also disclosed.

21 Claims, 8 Drawing Sheets

LEAD DELIVERY APPARATUS

BACKGROUND OF THE INVENTION

1. Field of the Invention

The present invention relates to an apparatus for delivery of a predetermined volume of lead to a mould and in particular, but not exclusively, to such apparatus for use in manufacturing cast on straps during the manufacture of batteries.

2. Description of the Related Art

In the manufacture of batteries, particularly for example lead acid batteries, it is known to cast straps and other formations onto the lugs of battery plates so as to, for example, form a connection between a set of plates within a cell of the battery. Such straps are generally cast by filling a mould cavity with lead and dipping lugs into the cavity prior to the cooling of the lead. Typically, the mould cavities are filled by allowing lead to flow into channels at the sides of the cavities and spill over a weir into the mould. An example of such a moulding apparatus is shown in the Applicant's earlier application WO94/16466. In order to ensure a good connection between the lugs and casting, the lead must remain hot until the lugs are in position. However, in order to minimize cycle time in production, the lead must be cooled as quickly as possible once the plates are in position.

It is important that the volume of lead is carefully controlled during strap casting as excess lead (for example as a result of mould features such as weirs) will have an impact on both the cost and weight of the final battery produced.

BRIEF DESCRIPTION OF THE INVENTION

Embodiments of the invention seek to provide an apparatus which may provide consistent measuring of lead and/or provide delivery of lead with minimal cooling during transit to the mould and/or enable unimpeded access to the mould by the plates.

According to a first aspect an apparatus for delivering a predetermined volume of lead to a mould includes a housing defining a lead reservoir having a lead outlet defined in its base and in communication with the reservoir; a runway beneath the base, spaced from the base and generally parallel thereto; a block slidably mounted between the base and the runway and defining a through cavity having the predetermined volume for receiving lead from the outlet in a first position and for releasing the lead in a second position; and a mechanism for reciprocating the block between the first and second positions.

This apparatus enables a single controlled volume of lead to be delivered accurately to an outlet location. In addition to ensuring a consistent volume of lead being delivered to a mould, the apparatus may also ensure that the lead can be delivered from the reservoir with minimal heat loss.

The cavity may have an upper inlet which is aligned with the lead outlet in the first position. The cavity may have a lower delivery port which can deliver lead in the second position. The cavity may be substantially ceiling-less, for example, the upper inlet of the cavity may be sized and shaped to match the lead outlet in the base of the housing. Alternatively, the cavity upper inlet may be smaller than the outlet in the base of the housing such that it lies within the outlet in the first position. Such an arrangement has been found to ensure that dross does not form within the cavity of the block but will instead float up the top of the reservoir from which it can be easily skimmed.

The runway may be provided with an opening at the second position. Alternatively, the runway may be arranged to stop short of the second position. The opening or runway end may be arranged to guide lead which is released from the cavity.

The housing may define a bleed opening, which may be aligned in the second position for allowing the ingress of gas into the upper part of the cavity in the second position. Thus, advantageously the bleed opening assists with smooth delivery of the volume of lead when the block is in the second position.

The block may further include a passageway, for example a through hole, for connecting the reservoir to a lead supply when the block is in the first position. The lead supply may, for example, be a constant head lead supply.

The apparatus may further comprise a drive mechanism for reciprocating the block. For example, the drive mechanism may comprise a crank mechanism.

The facing surfaces of the block and the reservoir may form a seal therebetween. The facing surfaces of the block and the runway may form a seal therebetween. At least one of the, or each, pair of facing surfaces may be provided with a graphite coating. The base of the housing and the runway may be arranged at an incline such that any lead leakage is directed in a predetermined direction. A gully may be provided at the edge of the runway to contain any such leakage.

In some embodiments the lead may be released directly from the block at the second position into a mould. Alternatively, the apparatus may further comprise a chute defining a lead passageway for extending between the second position and a mould fill position. A passageway may be arranged to ensure that the turbulence of the flow of lead into the mould is minimized and ensure a quick and clean fill of the mould cavity. The passageway may include a channel and a gap at the mould fill position and the chute may further comprise a wall on the opposite side of the gap to the channel for directing lead downwards as it debouches from the channel. The channel may be an open channel, for example a half pipe channel.

The apparatus may further comprise a moveable support for supporting the chute and arranged to move the chute between a lead delivery position and a rest or store position (for example, the moveable support may be a carriage).

The block may comprise a plurality of cavities. For example, a plurality of cavities may be provided in which each cavity may be arranged to deliver a predetermined volume of lead to a different section of the mould (for example to form different straps). The cavities may have different volumes (for example one cavity may be for a strap and another may be for a strap including a post). Multiple cavities could be fed from a single reservoir. The reservoir may have a single lead outlet or could be provided with a lead outlet for each cavity.

The runway may be provided with a blind hole which is aligned with a cavity (and may, therefore, also be aligned with the inlet) when the block is in the first position. The cavity may be sized and shaped to match the outlet of the cavity (such that the blind hole may coextensive with the cavity when the block is in the first position). The blind hole may be arranged to provide a sump below the cavity for receiving lead. Advantageously, the provision of a sump helps to resist the build up of dross on the sealing surface between the runway and block.

The housing may be provided with a cover to define an enclosed ullage above the reservoir. Advantageously, the ullage may be filled with an inert gas which reduces or eliminates the formation of dross on the surface of the lead. Therefore, the housing may further include an inlet for the provision of an inert gas to the ullage. The bleed opening may be in communication with the ullage such that inert gas is drawn into the cavity during delivery of the lead. Advantageously, this has been found to reduce build up of lead oxides on the walls of the cavity which would otherwise cause "decay" in the measured volume of the cavity.

A lead delivery apparatus may comprise a plurality of apparatuses according to an embodiment of the invention. For example, a lead delivery apparatus may comprise at least two blocks linked together to reciprocate together.

According to a further aspect of the invention, there is provided a cast on strap machine including a mould comprising a mould block defining a plurality of mould recesses and an apparatus in accordance with an embodiment of the invention.

In some embodiments a block may be provided with a plurality of through cavities each having a predetermined volume for receiving lead from an outlet in a first position and for releasing the lead in a second position. For example, the cavities may each have a predetermined volume to match that required for a particular mould recess.

According to a further embodiment of the invention, there is provided a lead delivery apparatus comprising a delivery chute which, in use, defines a passageway between a lead delivery device and a mould wherein the chute is moveable between a lead delivery position, in which at least a portion of the chute is positioned over a mould, and a store position in which the chute does not overlie the mould.

The store position may be arranged to be below the plane of the upper mould surface.

The chute may be arranged to move across the surface of the mould before being displaced in a direction which is substantially perpendicular to the plane and the mould surface. For example, the chute may be translated across the surface of the mould from the first position in which it is positioned over the mould to a second position in which the chute does not overlie the mould and may then further move in a direction which is substantially perpendicular to the plane and mould surface to reach the store position. Alternatively the chute may be moved by a rotational movement.

At least part of the movement of the chute may be linked to the movement of a jig box which is arranged, in use, to bring a part into contact with the lead in the mould. For example, the chute may move across the surface of the mould before being moved below the level of the mould in conjunction with the movement of the jig box.

Whilst the invention has been described above, it extends to any inventive combination of features set out above or in the following description or drawings.

BRIEF DESCRIPTION OF THE SEVERAL VIEWS OF THE DRAWING

Specific embodiments of the invention will now be described in detail by way of example only and with reference to the accompanying drawings in which.

DETAILED DESCRIPTION OF THE INVENTION

Figure 1:
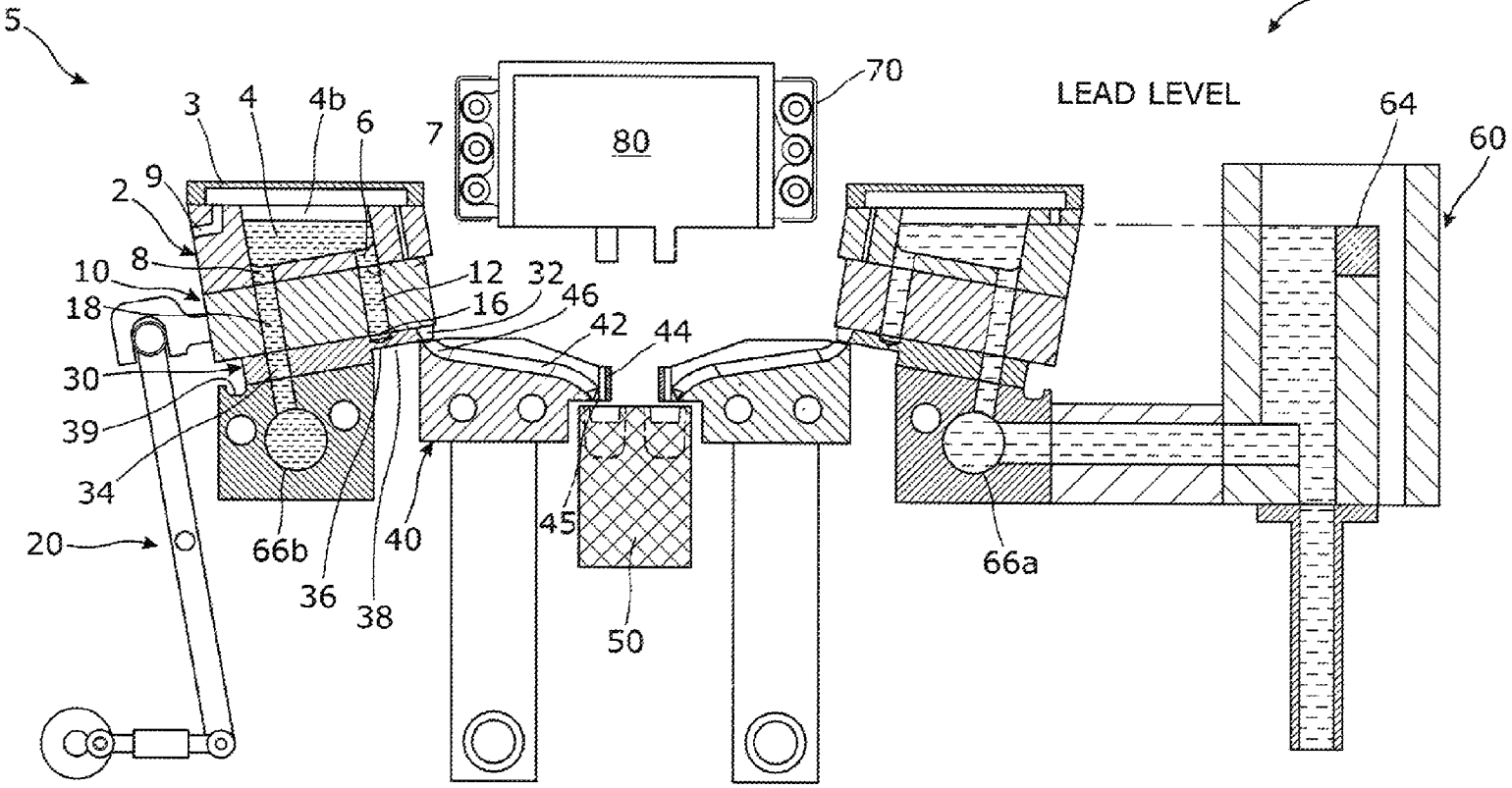
FIG. 1 is a schematic cross-section view of a cast on strap machine according to an embodiment of the invention.

A cast on strap machine 1 in accordance with an embodiment of the invention is arranged to provide liquid lead into the mould cavities of a mould 50 before tabs 82 of a set of battery plates 80 are moved into position by a jig box 70 with the tabs 82 within the mould cavities and the lead can solidify so as to form straps connecting the tabs. A lead delivery apparatus 5 is provided for delivering a predetermined volume of lead to the mould 50. The lead delivery apparatus 5 generally comprises a housing 2, which defines an inlet reservoir 4, a block 10, a mechanism 20, a runway 30 and a chute 40. The lead delivery apparatus 5 is connected to a lead supply 60. It will be noted that in the illustrated embodiment a pair of identical lead delivery apparatus are provided to deliver to opposing sides of the mould 50 (and fed from a common lead supply 60). It will be appreciated that this will depend upon the type of mould to be formed and therefore the invention may be used in a single or multiple arrangements. For clarity, the following description will describe the operation of only a single side of the apparatus but it will be appreciated from the figures that the two sides operate in an identical fashion (albeit with their motions mirrored).

The housing 2 defines a lead reservoir 4 in its interior and is generally arranged to have an open upper surface such that dross which accumulates maybe easily skimmed from the lead in the reservoir. An inlet 8 is provided for the supply of lead and an outlet 6 is provided in the base of the reservoir.

The housing may further be provided with a cover 3 which encloses the reservoir 4 but which is spaced apart from the lead fill level of the reservoir. As such an ullage **4*b* (i.e. an unfilled space) is defined above the reservoir 4. A gas inlet 9 is provided at the rear of the housing 4 which extends into the ullage 4*b* such that, in use, the ullage 4*b* may be filled with an inert gas (for example pure nitrogen or argon). Typically, the gas will be introduced at atmospheric pressure (so as not to effect the flow of lead) but with a flow rate which is sufficiently high to expel the air from the ullage 4*b***.

The housing is further provided with a bleed opening 7 which (as described in below) is arranged to be aligned with the through cavity 12 when the block 10 is in the second position. The bleed opening 7 is in fluid communication with the ullage **4*b* of the housing 2**.

Spaced apart from, and below, the housing 2 is a runway 30 which is arranged parallel to the lower surface of the housing and defines a slot therebetween which is shaped and sized to receive a block 10. The runway is provided with a through hole 34 aligned with the inlet 8 on the housing 2 and a blind recess 36 in alignment with the outlet 6 of the housing 2 (the blind recess 36 will form a sump as described below). The runway 30 is sloped relative to the horizontal such that it's inward (i.e. closest to the mould 50) end is higher than its rearward end. This ensures that any lead which escapes during operation of the machine will run away from the mould 50. Adjacent to the rearward (and lowermost) point of the runway 30 there is provided a gully 39 (which may be formed as part of the runway 30 or the lead supply pipe 66*a*, 66*b* which is positioned below the runway) for catching any lead leakage. The gully may be arranged to return the lead to the lead supply 60.

The block 10 is provided with a through cavity 12 and a through hole 18. In the non-displaced position of the block 10 the through hole 18 is aligned with the inlet 8 and through hole 34 to form the inlet path to the lead reservoir 4. In the same position, the through cavity 12 is aligned with the outlet 6 of the lead reservoir 4 and the blind hole 36 of the runway 30 such that lead from the reservoir will enter the blind hole 36 and cavity 12.

The mechanism 20 comprises a crank mechanism attached to the block 10 and arranged (as described below with reference to FIGS. 2 to 5) to move the block between its neutral position and a lead delivery position.

A chute 40 is provided which defines a passageway 42 which, in use, is arranged to deliver lead from the block 10 to the mould 50. The passageway 42 defines an inclined pathway for the lead and is provided with radiused corners to ensure smooth flow and minimise turbulence of the lead. The chute is provided with a moveable support 48 which is arranged to move the chute between a delivery position and a retracted position (as will be described in more detail with reference to FIGS. 2 to 5). A wall 44 is provided at the end of the chute 40 proximal to the mould 50 and a gap 45 is provided between the passageway 42 and wall 44. The gap 45, thus, forms an outlet to the chute 40.

Figure 2:
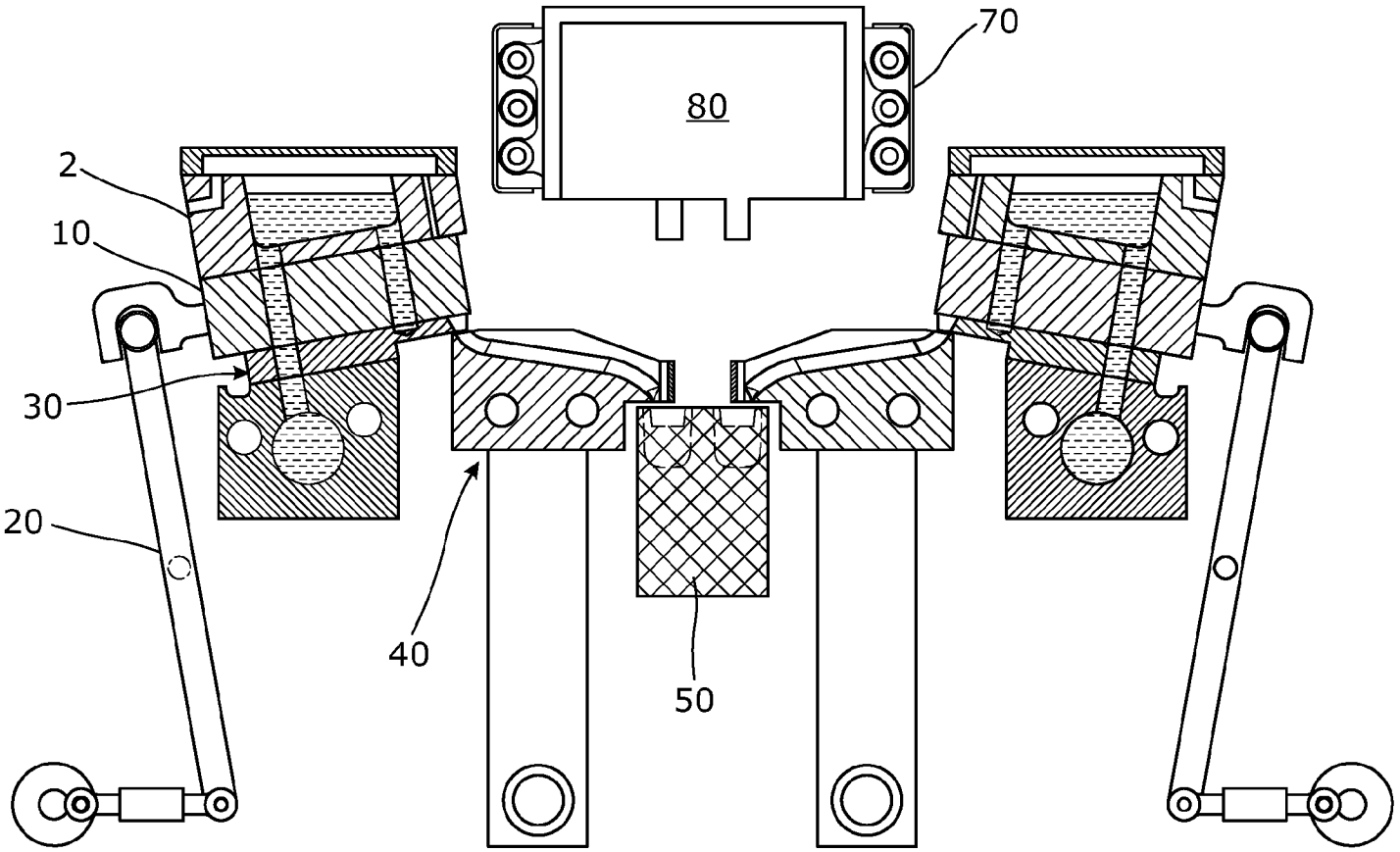
FIG. 2 is a schematic view of the embodiment of FIG. 1 in the reservoir and cavity fill position.

FIG. 2 shows the apparatus in its starting position in which the block 10 is aligned such that the through cavity 12 is below the outlet 6 of the lead reservoir 4 and the through hole 18 is aligned with the inlet 8 of the lead reservoir 4. Thus, lead will flow from the constant head lead supply 60 (as shown in FIG. 1) through supply pipes 66*a* and 66*b* (which may typically be heated) and hole 34 in the runway 30 into the reservoir 4. The reservoir will be maintained at a fill level defined by the head of the lead supply 60 (which is defined by a weir 64). As the through cavity 12 is in fluid communication with the lead reservoir 4, a predetermined volume of lead will fill the cavity 12 and an additional volume of lead will enter the blind hole 36 so as to provide a sump below the cavity 12. It will be noted that in this step the chutes 40 are already in the delivery position in which the passageway 42 is below the end 32 of the runway 30 and the gap 45 which defines the outlet of the chute is positioned above the mould recess of the mould 50.

Figure 3:
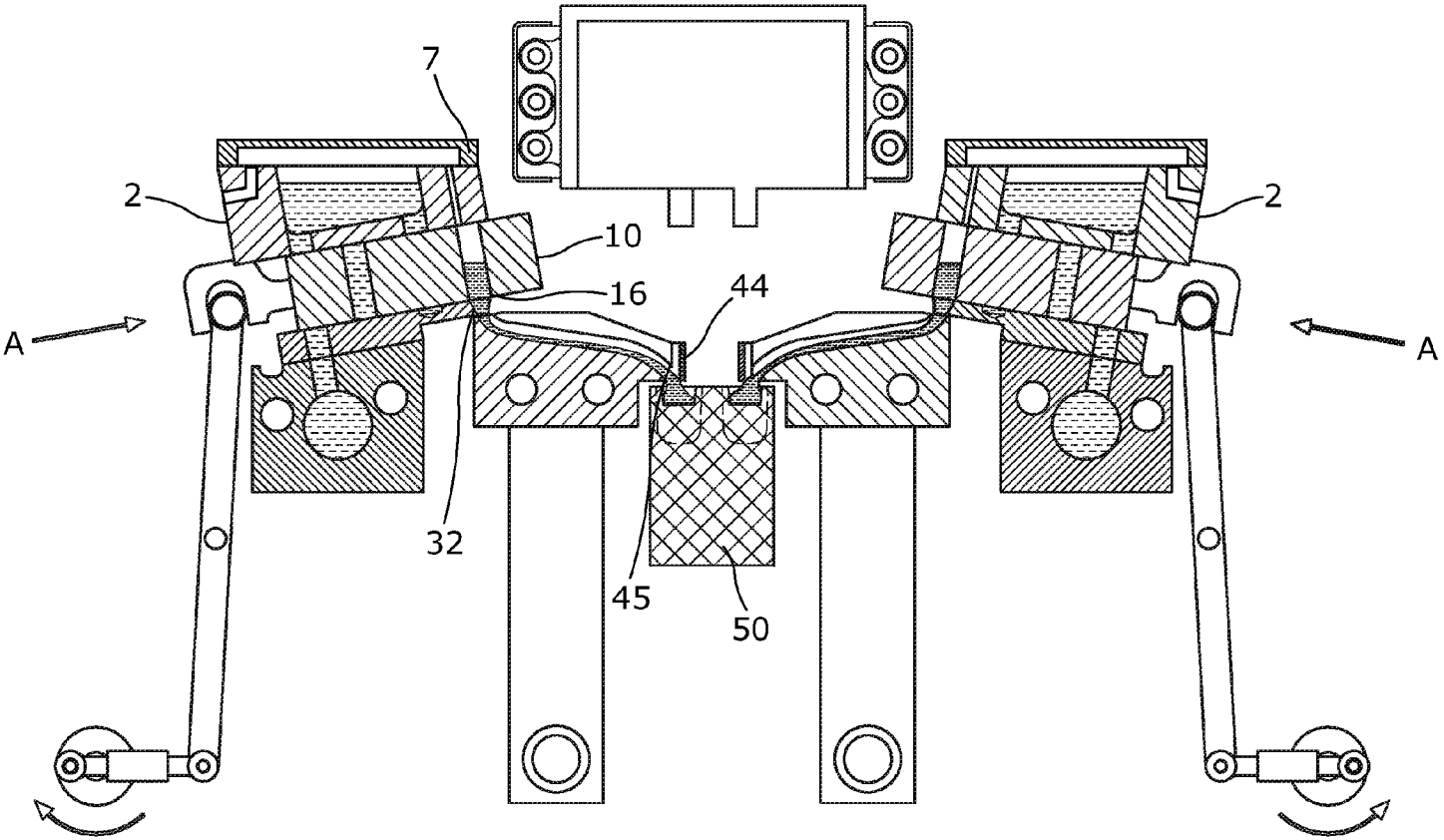
FIG. 3 is a schematic view of the embodiment of FIG. 1 in a lead delivery position.

To commence filling of the mould, the mechanism 20 is actuated to slide block 10 relative to the housing 2 and runway 30, as shown by the arrows A in FIG. 3. The actuation mechanism will be described in more detail with reference to FIG. 7 below, but may be any convenient mechanism which provides a reciprocating action of the block 10. The block 10 slides inwards towards the chute 40 until it reaches its second position (as shown in FIG. 3) in which the delivery port 16 of the through cavity 12 is aligned with the end 32 of the runway 30. In this position the bleed opening 7 provided in the housing 2 is in fluid communication with the inlet of the through cavity 12 such that gas may be drawn into the upper portion of the through cavity 12. This arrangement helps to avoid any vacuum effect which may hinder the release of the lead within the through cavity 12. Further, since the bleed opening 7 is in fluid communication with the ullage 4*b* the gas drawn into the cavity is inert gas. Advantageously, this has been found to reduce or avoid the formation of lead oxides on the surfaces of the through cavity 12 which would otherwise (over the course of many cycles) reduce the volume defined by the through cavity 12. This will, therefore, reduce the downtime required for cleaning and maintenance of the machine.

The end 32 of the runway 30 and the outermost portion of the open passageway 42 are arranged to provide a gradual downward transition to guide the lead onto the chute with minimal turbulence which could otherwise result in splashing. The lead passes along the downwardly curved passageway until reaching the gap 45 which provides the outlet to the chute 40. The wall 44 ensures a clean downwardly directed delivery of the lead into the mould cavity 50 with any lead which overshoots the gap 45 striking the wall and being downwardly directed back through the gap 45.

Figure 4:
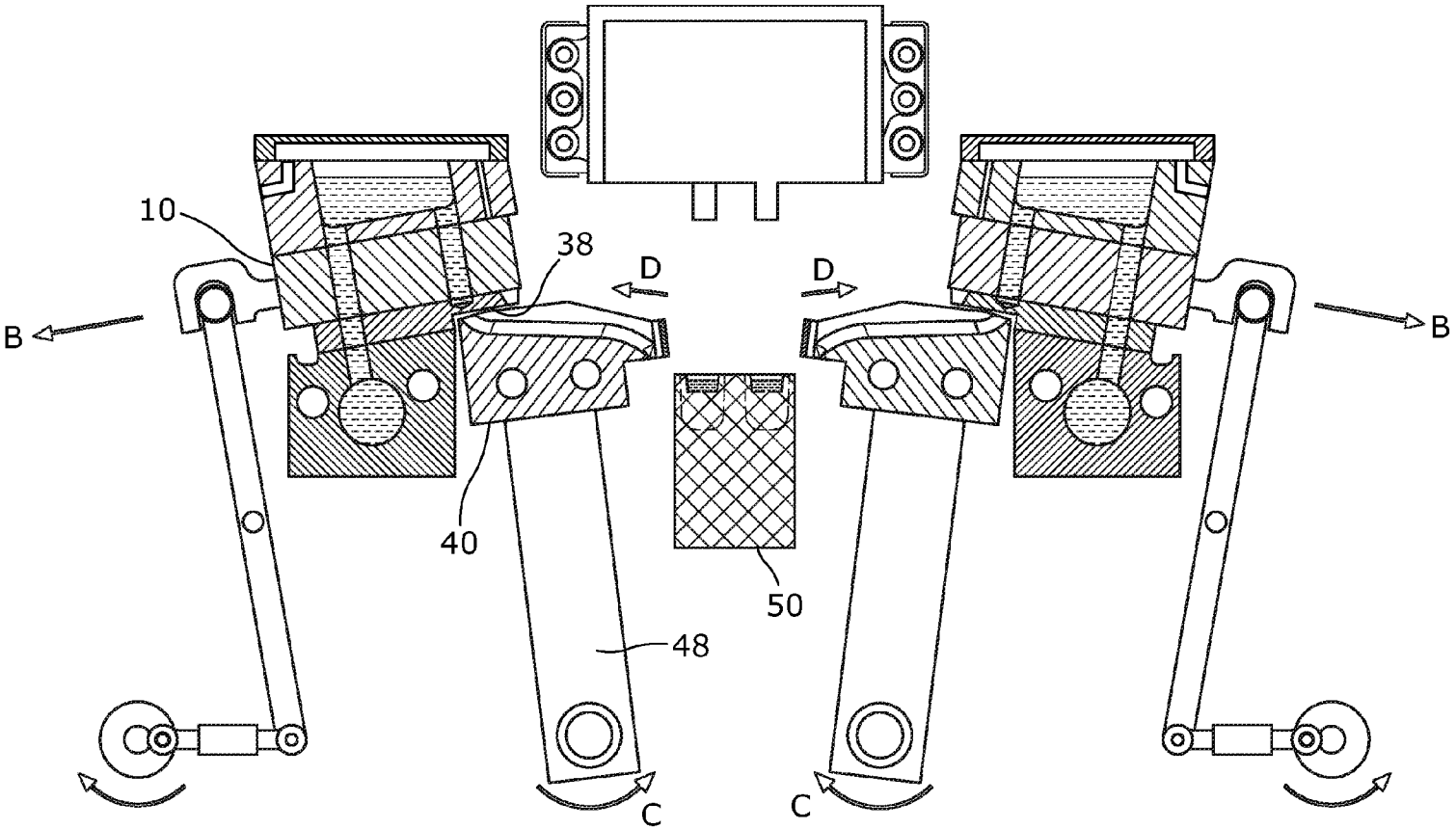
FIG. 4 is a schematic view of embodiment of FIG. 1 immediately after lead delivery and with the chutes in their first retracted position.

Once the lead pouring has completed, the block 10 returns to its first position in which the through cavity is aligned with the outlet 6 of lead reservoir 4 (moving in the direction of arrows B shown in FIG. 4). In this position the reservoir is again in fluid communication with the lead supply such that the level of the reservoir will be replenished and the through cavity 12 will be refilled. At this stage the chute 40 is retracted from its lead delivery position by being moved away from the mould 50 towards the housing 2. The chute is moved by rotation of the moveable support 48 in the direction shown by arrows C, resulting in the chute 40 moving in the direction of arrows D. A cut-out 38 is provided in the lower surface of the runway 30 to accommodate the initial movement of the chute. The cut-out is a stepped portion in the lower surface and may for example be a slot of substantially equal width to that of the chute.

Figure 5:
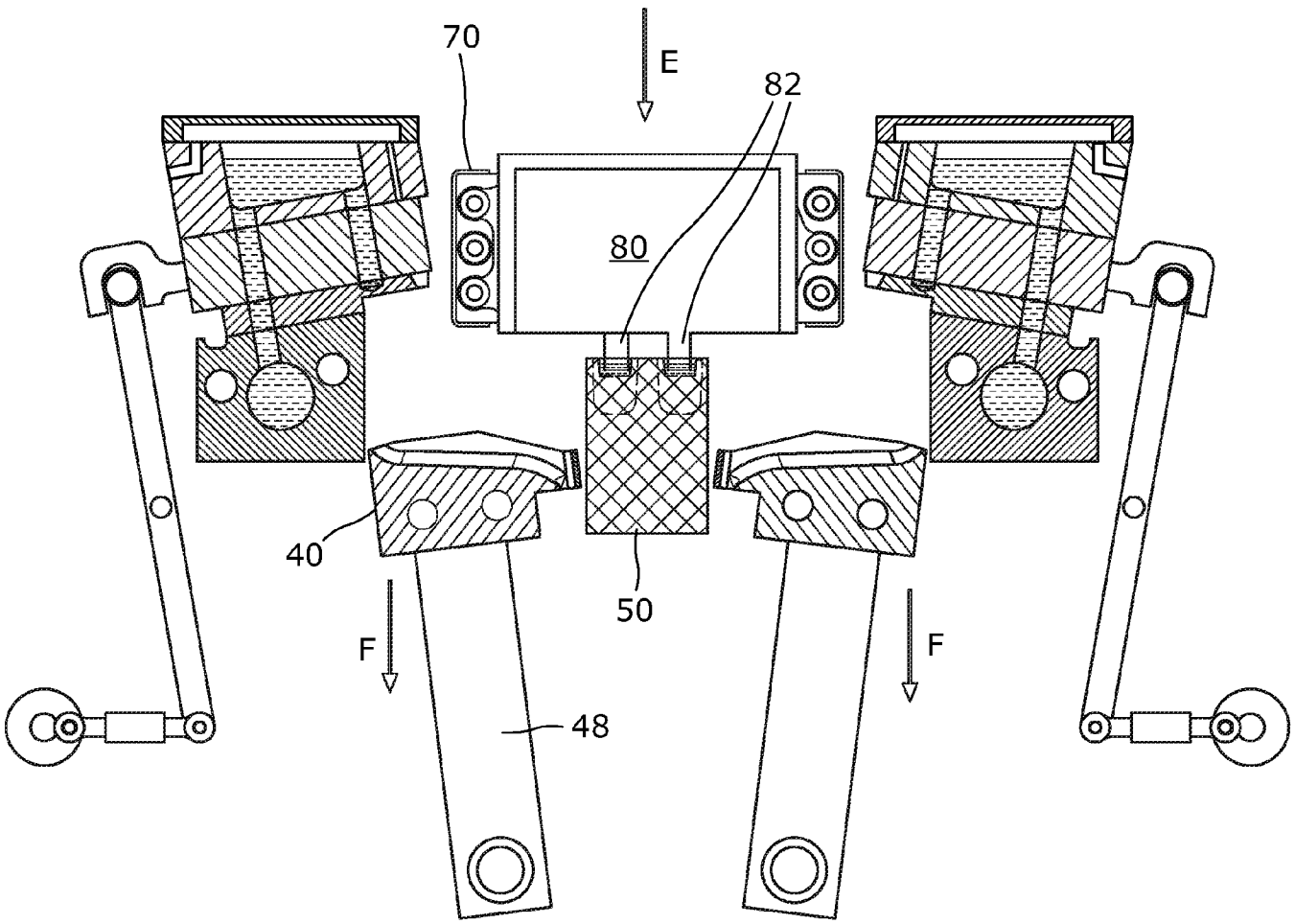
FIG. 5 is a schematic view of the embodiment of FIG. 1 with the battery plates brought into contact with the mould and the chutes in their fully retracted position.

As shown in FIG. 5, the battery plates 80 are brought into position above the mould 50 by a downward motion (in the direction of arrow E) until the tabs 82 of the plates lie within the mould cavity (which now contains molten but cooling lead). A mechanical connection is provided between the moveable support 48 of the chute 40 and the jig box 70 such that the chutes move down (as shown by arrow F) below the upper surface of mould 50 in conjunction with the movement of the battery plates 80 towards the mould 50. This is advantageous since the chute 40 will be hot (and may typically be heated to ensure the required delivery temperature of the lead is achieved) and may help to avoid any damage to the battery plates (or, more specifically, to the separators between the battery plates). This arrangement may, for example, enable the height of the tabs 82 to be reduced and/or may eliminate the need for providing a cooling air supply over the mould 50 as is known in conventional arrangements.

Figure 6:
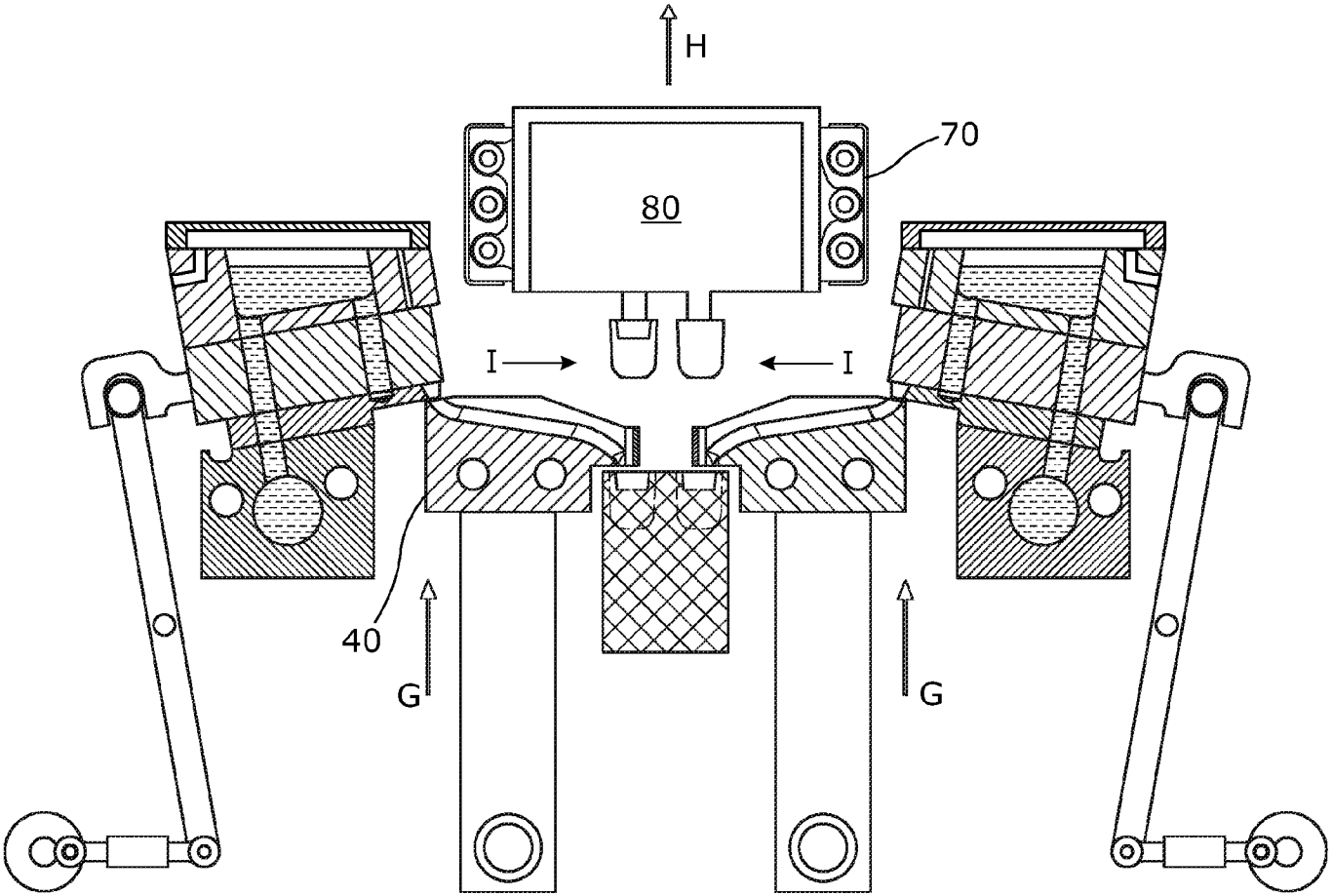
FIG. 6 is a schematic view of the embodiment of FIG. 1 as the straps are ejected.

Finally, as shown in FIG. 6, the battery plates 80 are moved away from the mould 50 by the jig box 70 (in the direction of arrow H) and eject the formed straps with the tabs 82. In conjunction with the movement of the jig box 70 the chutes 40 are moved upwards (in the direction of arrow G) and rotated inwards (in the direction of arrow I) to return to the delivery position.

Figure 7:
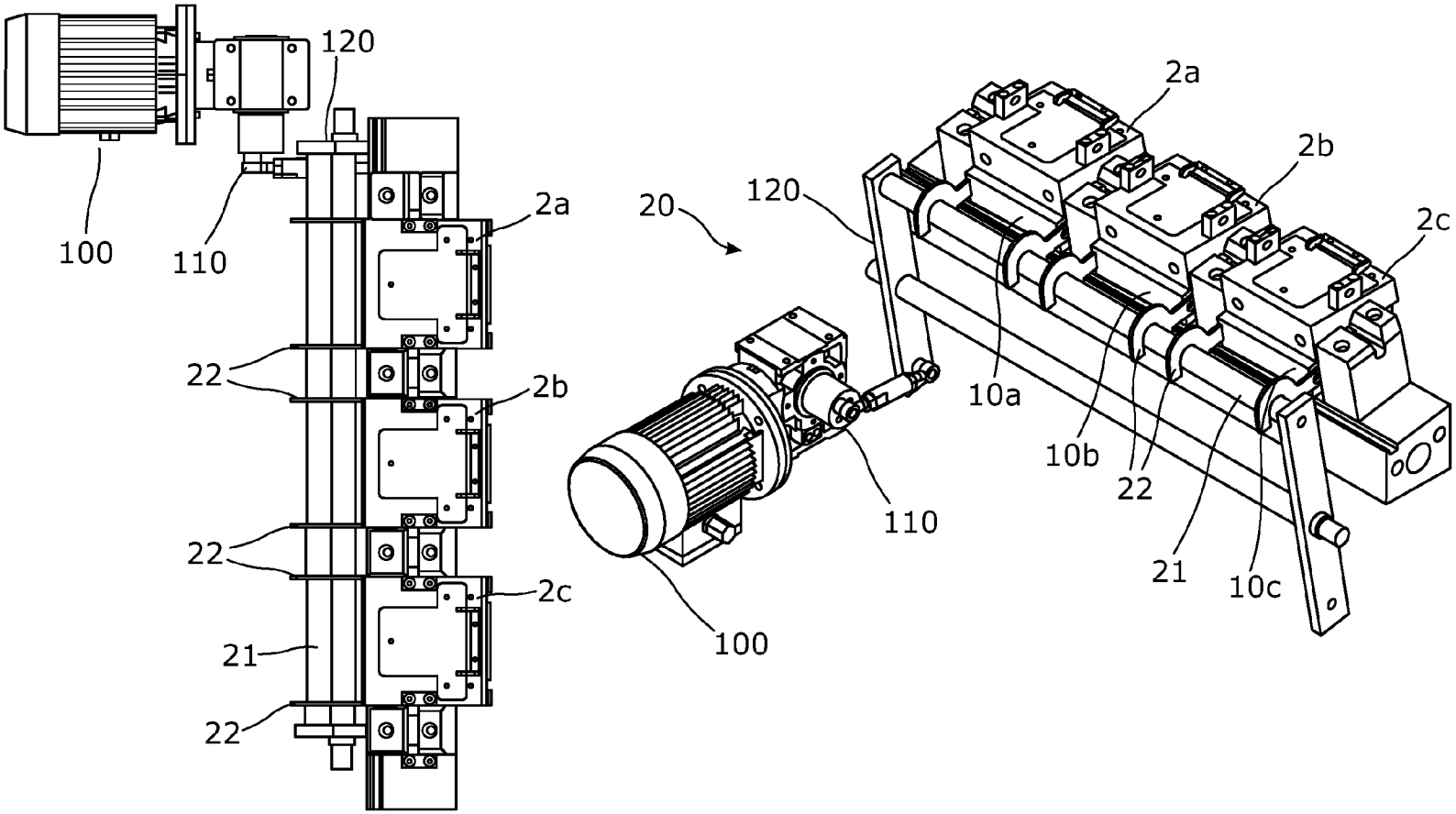
FIG. 7 is a schematic view of a mechanism for use in embodiments of the invention.

FIG. 7 shows a mechanism 20 suitable for use in embodiments of the invention. The mechanism comprises a drive motor 100 arranged to rotate a crank 110 which is connected via a lever arm 120 to the block 10. It will be noted that a plurality of blocks 10*a*, 10*b* and 10*c* may each be connected to a common mechanism for actuation in use. Each block 10 is associated with a separate housing 2*a*, 2*b* and 2*c* defining an independent lead reservoir, each of which is in fluid communication with the feed line 66*a*, 66*b*. A simple connection may be provided between the block 10 and the mechanism 20, for example a bar 21 and hook arm 22 arrangement, such that the block 10 and mechanism 20 may easily be disconnected for example to clean the block, housing or runway, or to replace the block (for example, to provide a block with a different capacity through cavity 12).

Figure 8:
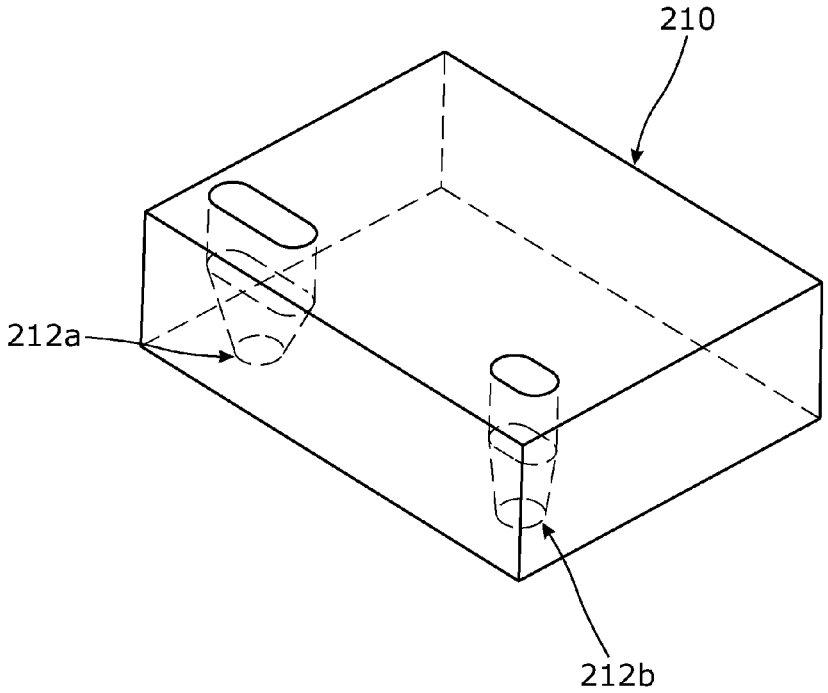
FIG. 8 is a schematic view of a multiple cavity block for use in embodiments of the invention.

In some embodiments it may be desirable to provide a plurality of through cavities in a single block 210 as shown in FIG. 8. Each cavity 212*a* and 212*b* may have a different predetermined volume depending on the mould feature for which the lead is acquired. For example, a larger mould cavity 212*a* may be provided for forming a post detail while a small mould cavity 212*b* may be provided for forming a strap. The cavities 212*a* and 212*b* may be suitably shaped such that their delivery ports and are of a standard profile such that no modification is required to the chute 40.

All of the invention has been described above with reference to one or more preferred embodiments. It will be appreciated that various changes or modifications may be made without departing from the scope of the invention as defined in the appended claims.

For example, the skilled person will appreciate that while the embodiment above has been primarily described in relation to the forming of straps, other formations may also be cast onto the lugs of battery plates (for example posts) and that a cast on strap machine may be used for the formation of any such formations without departing from the scope of the invention.

In some embodiments it may be advantageous to provide a plurality of cavities 12 arranged to deliver lead to a single mould cavity. For example, this may be desirable for relatively large mould cavities. The plurality of cavities could be in multiple blocks or in single multiple cavity block (of the type shown in FIG. 8) For example, each cavity may measure a separate volume of lead and the total volume of the cavities may provide the volume required for the particular mould cavity. The cavities may for example deliver to different areas of a single mould cavity to ensure an even distribution of lead.

The invention claimed is:

1. Apparatus for delivering a predetermined volume of molten lead to a mould comprising:

a housing defining a molten lead reservoir having a base, the housing including a lead outlet extending through the base of the reservoir, the outlet being in communication with the reservoir; and a molten lead inlet in connection with the reservoir, which in use is connected to a molten lead supply;

a runway located beneath the base of the reservoir, spaced from the base of the reservoir, and extending generally parallel thereto;

a block slidably mounted between the reservoir base and the runway, the block being slidably moveable between a first position and a second position, the block including a through cavity having the predetermined volume for receiving molten lead from the reservoir outlet when the block is in the first position and for releasing the molten lead when the block is in the second position; and a mechanism for reciprocating the block between the first and second positions.

2. Apparatus as claimed in claim 1, wherein the cavity has an upper inlet alignable with the lead outlet in the first position and a lower port which can deliver lead in the second position.

3. Apparatus as claimed in claim 2, wherein the runway stops short of or has an opening at the second position.

4. Apparatus as claimed in claim 1, wherein the housing defines a bleed opening aligned with the second position for allowing the ingress of gas to the upper part of the cavity.

5. Apparatus as claimed in claim 1, wherein the housing is provided with a cover to define an enclosed ullage above the reservoir and wherein the housing further includes an inlet for the provision of an inert gas to the ullage.

6. Apparatus as claimed in claim 1, wherein the block includes a through hole for connecting the reservoir to a lead supply where the block is in the first position.

7. Apparatus as claimed in claim 1, further including a drive mechanism for reciprocating the block.

8. Apparatus as claimed in claim 1, wherein facing surfaces of the block and the reservoir form a seal therebetween.

9. Apparatus as claimed in claim 1, wherein facing surfaces of the block and runway form a seal.

10. Apparatus as claimed in claim 1, including a constant head lead supply for supplying lead to the reservoir.

11. Apparatus as claimed in claim 1, further including a chute defining a lead passageway for extending between the block in its second position and a mould.

12. Apparatus as claimed in claim 11, wherein the passageway includes a channel and a gap at an end of the channel proximal to the mould, and the chute further includes a wall provided on the opposite side of the gap to the channel such that the gap is provided between the channel and the wall, for directing lead downwardly as the lead debouches from the channel.

13. Apparatus as claimed in claim 12, wherein the channel is an open channel.

14. Apparatus as claimed in claim 11, including a movable support for supporting the chute for movement between a lead delivery position and a rest position.

15. Apparatus as claimed in claim 11, further including a carriage for the chute for moving the chute between a lead delivery position and a store position.

16. Apparatus as claimed in claim 1, wherein the block comprises a plurality of through cavities each arranged for delivering a predetermined volume of lead to a different section of a mould.

17. Apparatus as claimed in claim 1, wherein the runway further comprises a blind hole which is aligned with the cavity when the block is in the first position.

18. Lead delivery apparatus including a plurality of apparatuses as claimed in claim 1.

19. Lead delivery apparatus as claimed in claim 18, wherein at least a pair of blocks are linked together to reciprocate together.

20. A cast on strap machine including a mould comprising a mould block defining a plurality of mould recesses and an apparatus for delivering a predetermined volume of molten lead for each recess including:

a housing defining a molten lead reservoir having a base, the housing including a lead outlet extending through the base of the reservoir, the outlet being in communication with the reservoir, and a molten lead inlet in connection with the reservoir, which in use is connected to a molten lead supply;

a runway located beneath the base of the reservoir, spaced from the base of the reservoir, and extending generally parallel thereto;

a block slidably mounted between the reservoir base and the runway and defining a through cavity having the predetermined volume for receiving molten lead from the outlet in a first position and for releasing the molten lead in a second position; and a mechanism for reciprocating the block between the first and second positions.

21. A machine as claimed in claim 20, wherein at least a pair of blocks are linked together to reciprocate together.

* * * * *